US005875748A

United States Patent [19]

Haas et al.

[11] Patent Number: 5,875,748

[45] Date of Patent: Mar. 2, 1999

[54] DEVICE AND METHOD FOR OPERATING A VALVE DRIVE OF AN INTERNAL COMBUSTION ENGINE

[75] Inventors: Michael Haas, Weisendorf; Walter Speil, Ingolstadt, both of Germany

[73] Assignee: Ina Wälzlager Schaeffler OHG, Herzogenaurach, Germany

[21] Appl. No.: 73,382

[22] Filed: May 6, 1998

Related U.S. Application Data

[62] Division of Ser. No. 682,639, filed as PCT/DE95/00088 Jan. 26, 1995.

[30] Foreign Application Priority Data

Feb. 9, 1994 [DE] Germany ..... 44 04 145.4

[51] Int. Cl.[6] ..... F01L 13/00

[52] U.S. Cl. ..... 123/90.16; 123/90.43; 123/198 F

[58] Field of Search ..... 123/90.15, 90.16, 123/90.17, 90.36, 90.39, 90.41, 90.43, 198 F

[56] References Cited

U.S. PATENT DOCUMENTS

| | | | |
|---|---|---|---|
| 4,167,931 | 9/1979 | Motor | 123/198 F |
| 4,509,467 | 4/1985 | Seiki | 123/90.16 |
| 4,615,307 | 10/1986 | Kodama et al. | 123/90.16 |
| 5,090,364 | 2/1992 | McCarroll et al. | 123/90.16 |
| 5,099,806 | 3/1992 | Murata et al. | 123/90.16 |
| 5,193,496 | 3/1993 | Volkswagen | 123/90.16 |
| 5,247,913 | 9/1993 | Manolis | 123/90.16 |
| 5,357,916 | 10/1994 | Matterazzo | 123/90.16 |
| 5,361,733 | 11/1994 | Spath et al. | 123/90.16 |
| 5,402,756 | 4/1995 | Böhme et al. | 123/90.16 |
| 5,429,079 | 7/1995 | Murata et al. | 123/90.16 |
| 5,555,861 | 9/1996 | Mayr et al. | 123/90.16 |
| 5,651,335 | 7/1997 | Elendt et al. | 123/90.16 |
| 5,655,487 | 8/1997 | Maas et al. | 123/90.16 |

FOREIGN PATENT DOCUMENTS

| | | |
|---|---|---|
| A 42 10 567 | 10/1992 | Germany . |
| 93 06 685 | 6/1993 | Germany . |
| U 93 19 435 | 2/1994 | Germany . |
| A 43 14 619 | 11/1994 | Germany . |
| 60-1 11 009 | 6/1985 | Japan . |
| 61-2 01 807 | 9/1986 | Japan . |
| A 2 268 242 | 1/1994 | United Kingdom . |

*Primary Examiner*—Weilun Lo
*Attorney, Agent, or Firm*—Henry M. Feiereisen

[57] ABSTRACT

A valve drive of an internal combustion engine, includes a switching mechanism incorporated in a support element for support of a cam follower disposed in driving relationship between a camshaft and the gas exchange valve for switching a gas exchange valve to different valve lift curves in response to an operation of a cam arrangement, whereby the switching mechanism has a hollow cylindrical housing defining an axis and received within an enveloping outer casing, an inner element axially displaceable relative to the housing and so received within the housing as to form at their interface an annular gap, and a coupling mechanism movable in a radial direction in a first radial bore arrangement so as to couple the inner element with the housing in a base circle phase of the cam arrangement by bridging the annular gap to thereby maintain a contact of the cam follower upon the cam arrangement, and movable in a radial direction in a second bore arrangement which is spaced from the first radial bore arrangement in direction of the axis so as to effect a disengagement of the cam follower from the cam arrangement in a phase of maximum cam lift.

16 Claims, 9 Drawing Sheets

DEVICE AND METHOD FOR OPERATING A VALVE DRIVE OF AN INTERNAL COMBUSTION ENGINE

CROSS-REFERENCES TO RELATED APPLICATIONS

This application is a division of prior filed copending application Ser. No. 08/682,639, filed as PCT/DE95/00088 Jan. 26, 1995.

BACKGROUND OF THE INVENTION

The invention concerns a device for operating a valve drive of an internal combustion engine comprising a switching mechanism for switching to different valve lift curves of a gas exchange valve. The invention further concerns a method of operating a valve drive of an internal combustion engine.

Such switching mechanisms effect a reduction of friction in the valve drive especially at low to medium rotation speeds of the internal combustion engine by actuating only one of preferably two gas exchange valves in opening direction. However, since the switched-off element executes an idle stroke against the force of a spring, unnecessary friction still occurs on this element. In addition, the element in question is retained by the force of this spring on the control cam concerned. If, now, a switching-off is required at high rotation speeds, the spring used must be very strong but the limited design space restricts this possibility so that the maximum rotation speed of the internal combustion engine has also to be limited. Moreover, if the moment of time of re-switching is unfavorable, increasing noise and wear problems can occur.

SUMMARY OF THE INVENTION

It is thus an object of the present invention to provide an improved device and a method for operating a valve drive of an internal combustion engine, obviating the afore-stated drawbacks.

In particular, it is an object of the present invention to provide an improved device and a method for operating a valve drive of an internal combustion engine, which is so configured as to allow a disconnection of the cam follower from the cam with low friction even at medium to high rotation speeds and to permit a re-connection of the cam follower with low noise and wear.

These objects and others which will become apparent hereinafter are attained in accordance with the present invention by the fact that the switching mechanism is an integral part of or supports a cam follower arranged in driving relationship between a camshaft and the gas exchange valve, whereby the switching mechanism includes a hollow cylindrical housing defining an axis and received within an enveloping outer casing, an inner element axially displaceable relative to the housing and so received within the housing as to form at their interface an annular gap, and a coupling mechanism movable in a radial direction in a first radial bore arrangement so as to couple the inner element with the housing in a base circle phase of the cam arrangement by bridging the annular gap to thereby maintain a contact of the cam follower upon the cam arrangement, and movable in a radial direction in a second bore arrangement which is spaced from the first radial bore arrangement in direction of the axis so as to effect a disengagement of the cam follower from the cam arrangement in a phase of maximum cam lift.

The measures of the invention make it possible for the support element concerned to be uncoupled from the lifting contour of the control cam when a disconnection of the cam follower is desired. At the same time, the cam follower is out of driving relationship to the control cam so that the aforesaid detrimental friction losses are eliminated because the cam follower is thus only temporarily pressed against the control cam in case of uncoupling. The aforementioned further coupling element keeps the housing and the cam follower, which is force locked on the housing, out of contact with the lifting movement of the control cam after the housing of the switching mechanism has executed an idle stroke. The disadvantageous idle stroke of the housing relative to the inner element encountered in the prior art is eliminated by the invention. The hitherto required strong restoring spring inside the mechanism is no longer necessary so that high speeds of rotation are possible even in an uncoupled state of the switching mechanism. It is both conceivable and intended to use the switching mechanism of the invention in all types of valve drives for internal combustion engines, for instance in known types of switching tappets and other switching elements. The invention also covers other means of applying force to the coupling and uncoupling elements such as for example, magnetic, electromagnetic, mechanical (eccentric), pneumatic and other means. In addition, all types of selective force application to the coupling elements (coupling by spring force and uncoupling by a hydraulic medium, or vice versa) are also included in the subject matter of the invention.

For a hydraulic application of force to the coupling elements, it is particularly advantageous to configure these as pistons. However, coupling can also be achieved with rolling elements in the form of balls, or with pins or wedges etc. In all embodiments, the hydraulic piston is used only as a pushing element for another coupling element which then effects a direct coupling between the housing and the inner element. The important feature for most of the embodiments is that the recesses for the coupling and the pushing elements are of a complementary shape to the elements.

Suitably, the cam follower is a known type cup-shaped tappet. The peripheral surface of the tappet comprises a control edge which cooperates with a wedge-shaped coupling element projecting from the cylinder head. In this embodiment, switchable tappets known from the prior art can also be used. All that is necessary is to provide a supply duct and a lodging for the wedge-shaped coupling in the cylinder head of the internal combustion engine.

To neutralize the forced driving disconnection between the housing and the control cam in order to achieve a coupling of the cup tappet to the control cam, the coupling element can be displaced radially outwards by a compression spring.

In accordance with a simple variant of a forced driving disconnection of the cam follower from the control cam, the cam follower is a finger lever articulated on a support element which includes the switching mechanism, whereby the piston or pin extends in the first radial bore of the inner element of the switching mechanism and, to uncouple the finger lever from the cam, is displaced radially outwards into the further bore by the force of at least one compression spring, with a re-positioning of the piston or pin being effected by hydraulic medium. This embodiment does not comprise additional pistons to serve as coupling elements but the housing comprises at least one additional cam-proximate recess for the piston which is already present. Moreover, this and other embodiments of the invention also provide for a switching to partial strokes only of the control cam. These measures will not be described more closely here but they can be implemented by using axially spaced "coupling steps" in the switching element which, in this case, is made as a support element.

Advantageously, the hydraulic medium is routed through a supply duct of the surrounding structure in form of a cylinder head to a longitudinally extending annular gap which surrounds an outer peripheral surface of the housing at least in parts and communicates with bores intersecting the housing so that a radialy inward displacement of the piston or pin is enabled. However, it is also possible to apply force to the coupling elements simply through an oil supply duct.

In a further embodiment of the invention, the first and the further coupling elements of the switching mechanism are arranged in the housing. The further coupling element cooperates in a radially outward direction; with a recess of the cylinder head. The activation of both these coupling elements is effected simply by a supply duct in the cylinder head.

In accordance with an alternative solution of the present invention, the further coupling elements are arranged in the cylinder head and can be pressurized in coupling direction by the force of at least one compression Spring. An uncoupling of the first and the further coupling elements is achieved again simply by means of a control supply duct arranged in the cylinder head. The compression spring in this example is a coil spring but it is conceivable to use any elements having a spring effect and which can be accommodated in the available design space. Such elements may be made of gas-filled elastomers or may alternatively be disc Springs, conical Springs or other similar machine components.

It is particularly advantageous to provide for an additional displacement of the housing in a cam-distal direction in case of uncoupling. This additional travel is realized by the simple measure of making a bevel in the bore into which the further coupling element is displaced for uncoupling. In this way, the support element effects a forced and complete disconnection of the finger lever from the cam contour so that even the minimum friction occurring due to a contact of the cam tip with the finger lever is eliminated by simple means.

A simple measure for establishing the necessary connection between the switching mechanism and the cam follower is recited in a further sub-claim. Other conceivable devices for connecting the switching mechanism to the cam follower are, for example, bayone type or interlocking means or other engaging means arranged on the finger lever.

Advantageously, the duct for the hydraulic control of the coupling elements can also be used for supply of hydraulic medium to a hydraulic clearance compensation element. The use of a common control duct in the switching element is advantageous but a separate supply of hydraulic medium to the clearance compensation element is also conceivable. At the same time, it is conceivable and within the scope of the invention to implement a purely hydraulic switching of the elements both in the coupling and uncoupling direction.

Preferably, at least one of the elements of the switching mechanism is made of a light weight and/or polymeric material. This measure further contributes to a reduction of weight and minimization of friction in the valve drive.

In accordance with the present invention, a method of operating a valve drive of an internal combustion engine includes a first operational state in which one element of the cam follower or of a support element thereof destined to effect a large valve lift is retained in a bottom dead center position at maximum cam lift while being uncoupled from one another of the cam follower or of the support element, and in a second operational state in which the uncoupled element of the cam follower of of the support element comes to abut against the cam in a return phase of the cam defined by a phase comprised between a maximum lift of the gas exchange valve at valve speed zero and a minimum lift of the gas exchange valve at valve speed of approximately zero. The method of the invention for re-coupling the previously uncoupled element to its cam guarantees a low-wear and low-noise establishment of contact. This re-coupling can be realized, for example, at maximum cam lift so that the required displacement of the element to be coupled is kept to a minimum. However, it is also possible to effect re-coupling starting at maximum cam lift and increasing cam speed. However, in this case, the restoring compression spring of the element must be designed so that the speed of the element is higher than the speed of the leading cam. A preferred phase for effecting re-coupling is the phase preceding the base circle phase of the cam. The cam then practically has a braking effect on the now abutting, previously uncoupled element.

The invention is not limited to the features of the claims. Rather, combinations of individual features of the claims with one another and with the disclosures contained in the description of advantages and examples of embodiments are both conceivable and intended.

BRIEF DESCRIPTION OF THE DRAWINGS

The above and other objects, features and advantages of the present invention will now be described in more detail with reference to the accompanying drawing in which.

DETAILED DESCRIPTION OF PREFERRED EMBODIMENTS

Figure 1:
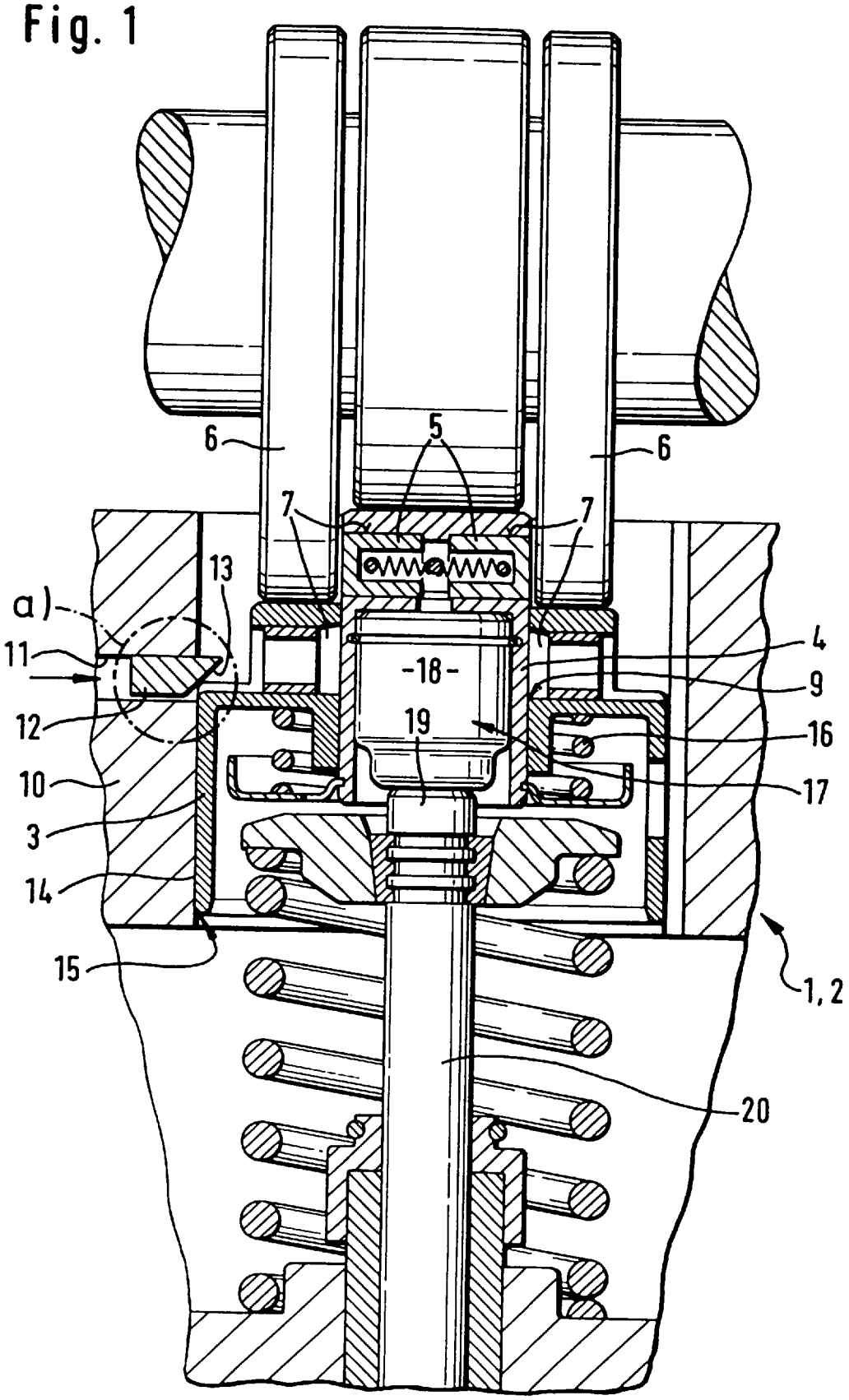
FIG. 1 is a longitudinal cross-section through a cup-shaped tappet, illustrating one embodiment of a switching mechanism for operating a valve drive.

FIG. 1 shows an embodiment of the switching mechanism 1 of the invention. The switching mechanism 1 is an integral part of a cam follower, in this case, in the form of a cup-shaped tappet 2. The tappet 2 comprises a housing 3 in which an inner element 4 is concentrically arranged. The inner element 4 is axially displaceable relative to the housing 3 and can be coupled thereto, in a base circle phase of the control cam 6, by coupling means in the form of first pistons 5, not specified, These pistons 5 extend in a first bore 7 of the inner element 4 and, in case of coupling in a base circle phase of the control cam 6, are displaced hydraulically into a first bore 7 of the housing 3 whereby they bridge an annular gap 9 formed between the housing 3 and the inner element 4.

A cylinder head 10 surrounding the housing 3 comprises a radially extending further bore 11 in which a radially inwards displaceable further coupling element 12 is positioned. If an uncoupling of the cup-shaped tappet 2 from the control cam 6 is desired, the coupling element 12 is displaced by hydraulic medium radially inwards in the bore 11 during a bottom dead center position of the housing 3 and engages a suitable recess in the housing 3. A radially inner end surface 13 of the coupling element 12 now extends beyond a peripheral surface 14 of the housing 3, i.e. it bridges an annular gap 15 formed between the housing 3 and the cylinder head 10. Due to this overlapping of the peripheral surface 14 of the housing 3 by the further coupling element 12, the housing 3 is "held back" from the control cam 6 in the uncoupled state of the switching mechanism 1. In this way, the compression spring 16 arranged in the housing 3 concentrically around the inner element 4 and which hitherto had the function of repositioning the inner element 4 relative to the housing 3, can be of smaller dimension or, in other words, the tappet 2 can be maintained in the uncoupled state even at medium to high rotation speeds of the internal combustion engine.

A hydraulic clearance compensation means 17, not specified, is arranged within the inner element 4. The pressure piston 18 of the hydraulic clearance compensation means 17 bears against an end 19 of a valve stem 20.

The structure and mode of functioning of the tappet 2 of the invention will not be described further since such tappets are well-known in the technical field.

Figure 2:
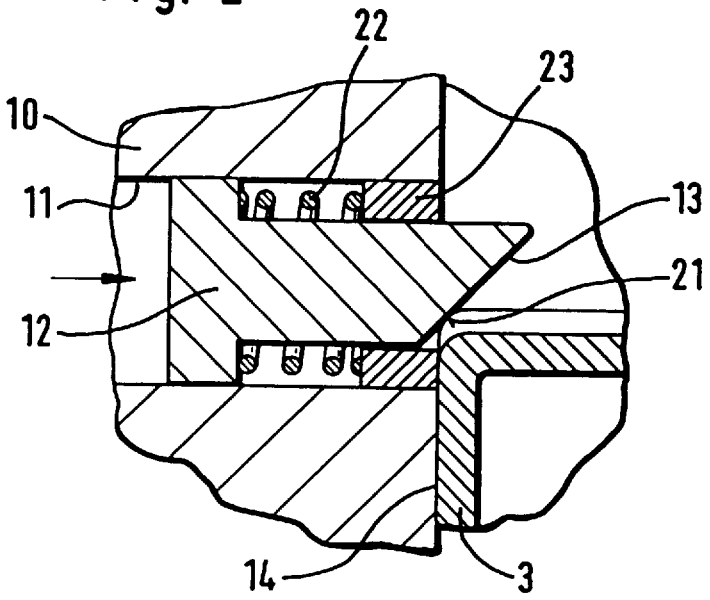
FIG. 2 is a cutaway view of the switching mechanism, on an enlarged scale, of an area marked a) in FIG. 1, showing operation of a coupling element.

FIG. 2 shows an enlarged detail a) from FIG. 1. As can be seen, the radially inner end surface 13 of the further coupling element 12 is configured as a plane inclined in valve direction. With this inclined plane, the further coupling element 12 cooperates with a facing control edge 21 arranged radially inward thereof on the peripheral surface 14 of the housing 3. When uncoupling of the cam follower 2 from the control cam 6 is desired, the inclined end surface 13 of the further coupling element 12 effects an additional travel of the housing 3 in cam-distal direction when the further coupling element 12 is displaced radially inwards. Thus, in this embodiment and in those of FIGS. 5, 7 and 8, the housing 3 is completely separated from engagement with the control cam 6 with the accompanying advantages already described. A re-positioning of the further coupling element 12 with falling hydraulic pressure can be assisted by a compression spring 22. This compression spring 22 is supported at a radially outer end on the further coupling element 12 and acts at a radially inner end on a ring 23 arranged around the further coupling element 12 in the further bore 11 of the cylinder head 10.

Figure 3:
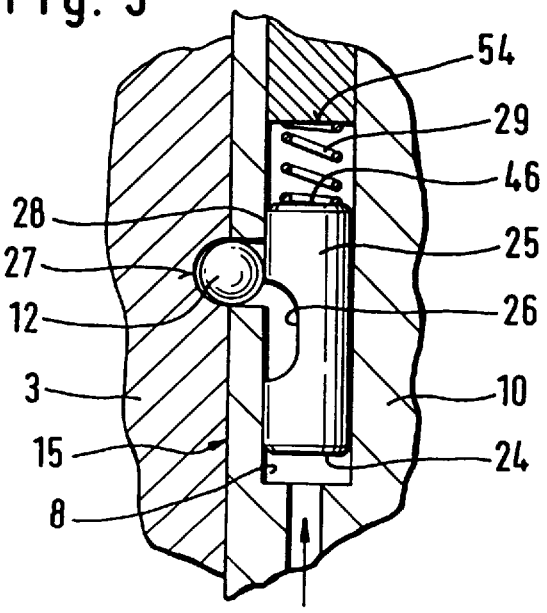
FIG. 3 is a fragmentary sectional view of a modified coupling element of the switching mechanism.

An alternative embodiment of the invention for a driving separation between the housing 3 and the control cam 6 is shown in FIG. 3. In this embodiment, an axially displaceable control element 25 (in this case, in the form of a hydraulic piston) exposed to hydraulic pressure at one front end 24 is arranged in the cylinder head 10 near the annular gap 15 formed between the housing 3 and the cylinder head 10. The control element 25 comprises a groove-shaped recess 26 facing the central axis of the switching mechanism 1. At the same time, a ball-shaped further coupling element 12 is shown in a spherical recess 27 of the housing 3. This coupling element 12 cooperates with the recess 26 of the control element 25 so that, to effect a desired uncoupling of the cam follower 2 from the control cam 6, the coupling element 12 is displaced radially inwards into the recess 27 by a peripheral surface 28 of the control element 25 whereby it bridges the annular gap 15 between the housing 3 and the cylinder head 10. To accomplish a desired coupling of the cam follower 2 to the control cam 6, the control element 25 is loaded by hydraulic pressure in opposition to the force of a compression spring 29 that the further coupling element 12 comes to be located directly opposite the recess 26 into which it then locks. The compression spring 29 of this embodiment therefore acts in a coupling direction.

Figure 4A:
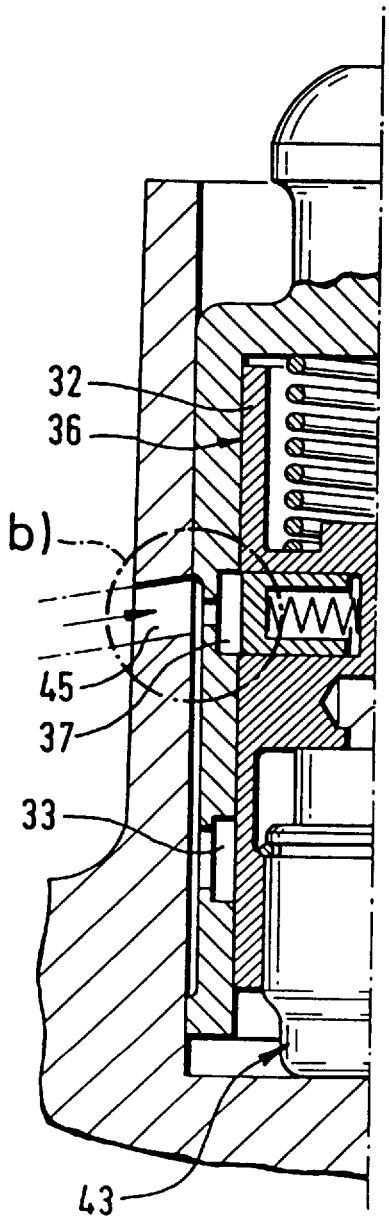
FIG. 4*a* is a sectional view of a first embodiment of a switchable cam follower configured as a support element, illustrating the switching mechanism in a position in which the finger lever is uncoupled from the control cam.
Figure 4B:
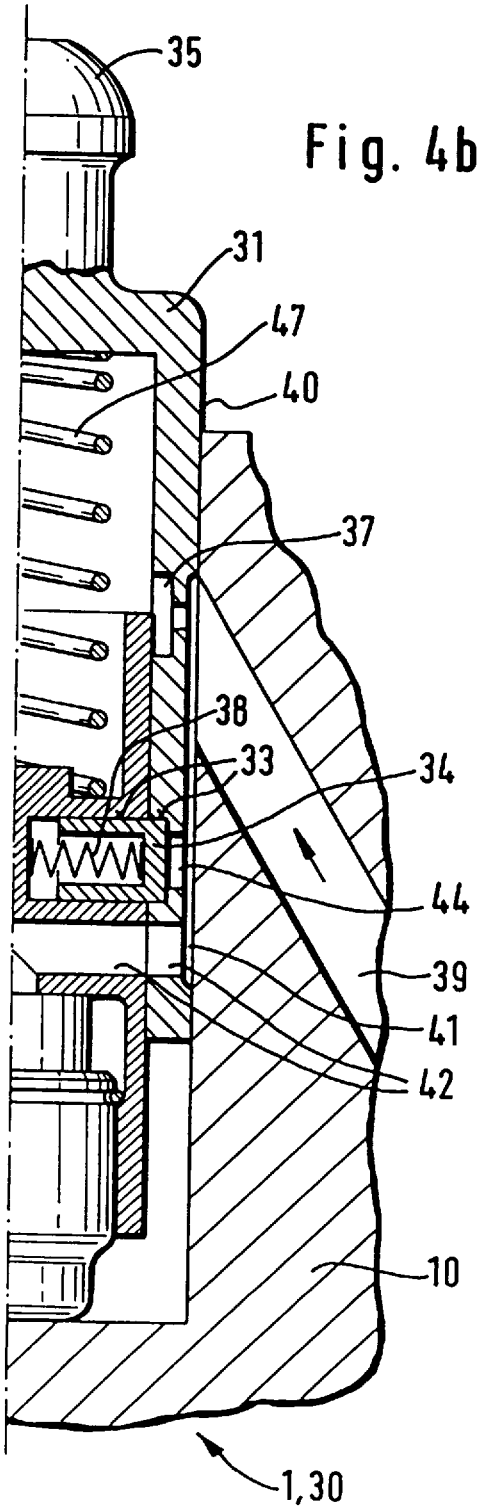
FIG. 4*b* is a sectional view of the support element in a position in which the finger lever is coupled with the control cam.

FIGS. 4*a* and 4*b* shows a further embodiment of the switching mechanism 1 of the invention configured in this case as a support element 30. This support element 30 comprises a hollow cylindrical housing 31 in which an axially displaceable inner element 32 which can be coupled to the housing 31 is arranged. A first radial bore 33 aligned in a base circle phase of the cam, not shown, extends in the housing 31 and in the inner element 32. A first piston 34 which is displaceable in its own longitudinal direction and which serves as a first coupling element is arranged in this bore 33. In case of coupling of a finger lever 53 (see FIG. 9) supported on an end 35 of the housing 31 to a control cam, not shown, the piston 34 is displaced in the first bore 33 that it bridges an annular gap 36 formed between housing 31 and the inner element 32.

The housing 31 comprises a further bore 37 (it is advantageous to provide two pistons 34 to engage into two bores 37) into which, to effect an uncoupling of the finger lever 53 from the control cam, the piston 34 is displaced out of the inner element 32 in the phase of maximum cam lift so as to bridge the annular gap 36 formed between the housing 31 and the inner element 32 (see FIG. 4*a*). A biasing in this coupling direction is achieved by the force of a compression spring 38 acting in radially outward direction on each piston 34. A re-positioning of the piston 34 is accomplished by hydraulic pressure.

Hydraulic medium is fed through a supply duct 39 arranged in the cylinder head 10. This supply duct 39 leads to a longitudinally extending annular gap 41 which surrounds at least parts of the peripheral surface 40 of the housing 31. In the base circle phase of the control cam, this annular gap 41 is intersected by a radial bore 42 extending through the housing 31 and the inner element 32. This bore 42 serves to assure a supply of hydraulic medium to a hydraulic clearance compensation means 43. The annular gap 41 is at the same time intersected at right angles by a further bore 44 through which hydraulic medium can act on the first coupling element 34. However, it is also conceivable and within the scope of the invention to provide a separate supply duct 45 in the cylinder head 10 for pressurizing the first piston 34 in the manner described above.

In FIG. 4*b*, the switching mechanism 1 is shown in the position in which the finger lever 53 supported thereon is retained in contact with the control cam. If, now, an uncoupling of the finger lever 53 from the contacting cam is desired, the pressure of hydraulic medium in the supply duct 39 is raised so that the piston 34 is displaced radially inwards. The housing 31 now performs an idle stroke in a cam-distal direction. At the physical limit of the stroke of the housing 31, the further bore 37 of the housing 31 registers with the first piston 34 (FIG. 4*a*). If, in the meantime, the hydraulic medium pressure has been reduced, the first piston 34 is displaced by the compression spring 38 into this further bore 37. In this way, the finger lever 53, not shown, is separated by force from the travel of the control cam. If this separation is wished to be neutralized, the hydraulic medium pressure can be raised via the supply duct 39, or 45, so that the first piston 34 is displaced radially inwards and the housing 31 is moved towards the cam by the force of a compression spring 47. When the upper dead center position of maximum axial displacement of the housing 31 relative to the inner element 32 is reached, the piston 34 locks into the first bore 33 of the housing 31 which is now situated opposite thereto provided the pressure of the hydraulic medium has been limited therebefore. The switching element 1 now functions in the manner of conventional support elements. The finger lever 53 follows the contour of the control cam so that the gas exchange valve concerned opens, and a required gas exchange cross-section opening into a combustion chamber is released. Since the basic principle of operation of the support element 30 of the invention is similar to that of the support elements of FIGS. 6 and 8, it will not be elaborated again when describing these figures.

Figure 5:
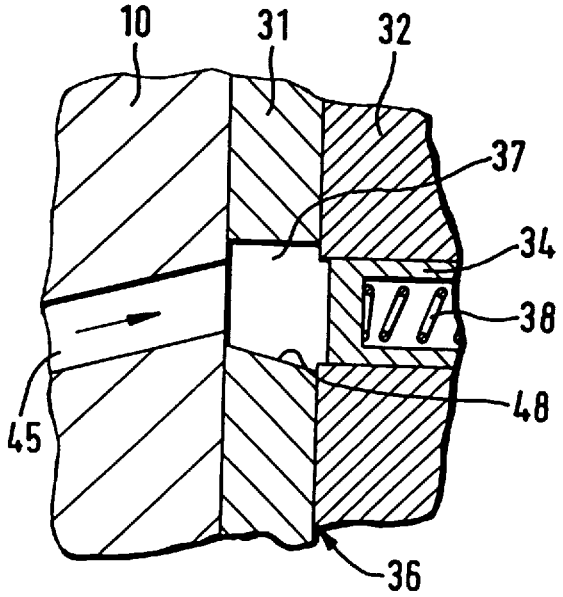
FIG. 5 is a sectional cutaway view of the switching mechanism in an area marked b) in FIG. 4*a*, showing means for effecting an additional stroke travel of the housing.

FIG. 5 shows an enlarged detail b) from FIG. 4*a* illustrating means for an additional travel of the housing 31 in a cam-distal direction analogous to that of FIG. 2. For a desired uncoupling of the finger lever 53 from the cam, the further bore 37 of the housing 31 comprises a bevel 48. Upon a radially outward displacement of the first piston 34 into the further bore 37, when it bridges the annular gap 36, the housing 31 effects an additional travel in cam-distal direction so that the housing 31 and the finger lever 53 are completely out of engagement with the control cam.

Figure 6A:
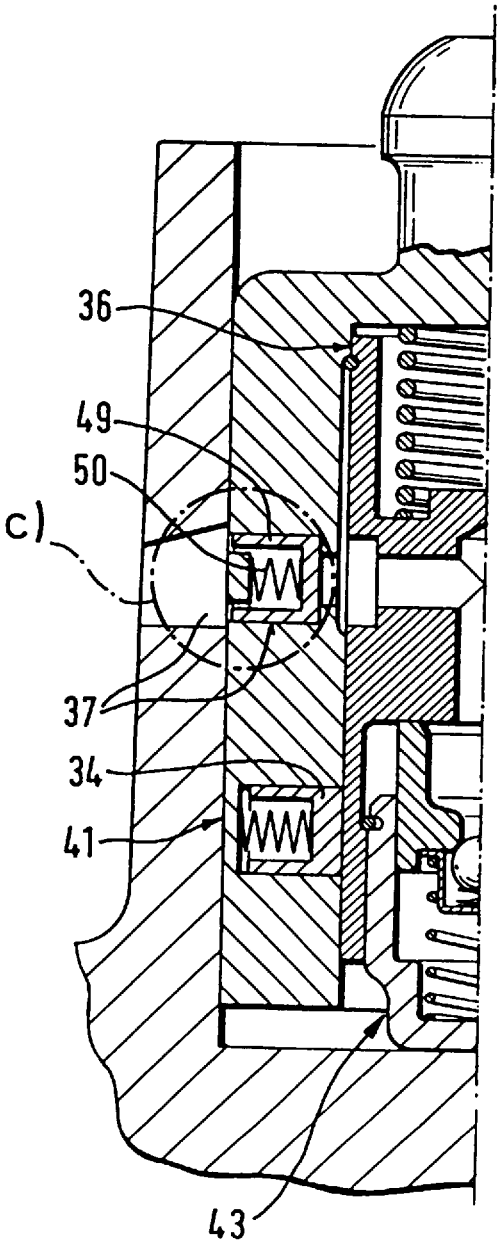
FIG. 6*a* is a sectional view of a second embodiment of a switchable cam follower configured as a support element, illustrating the switching mechanism in a position in which the finger lever is uncoupled from the control cam.
Figure 6B:
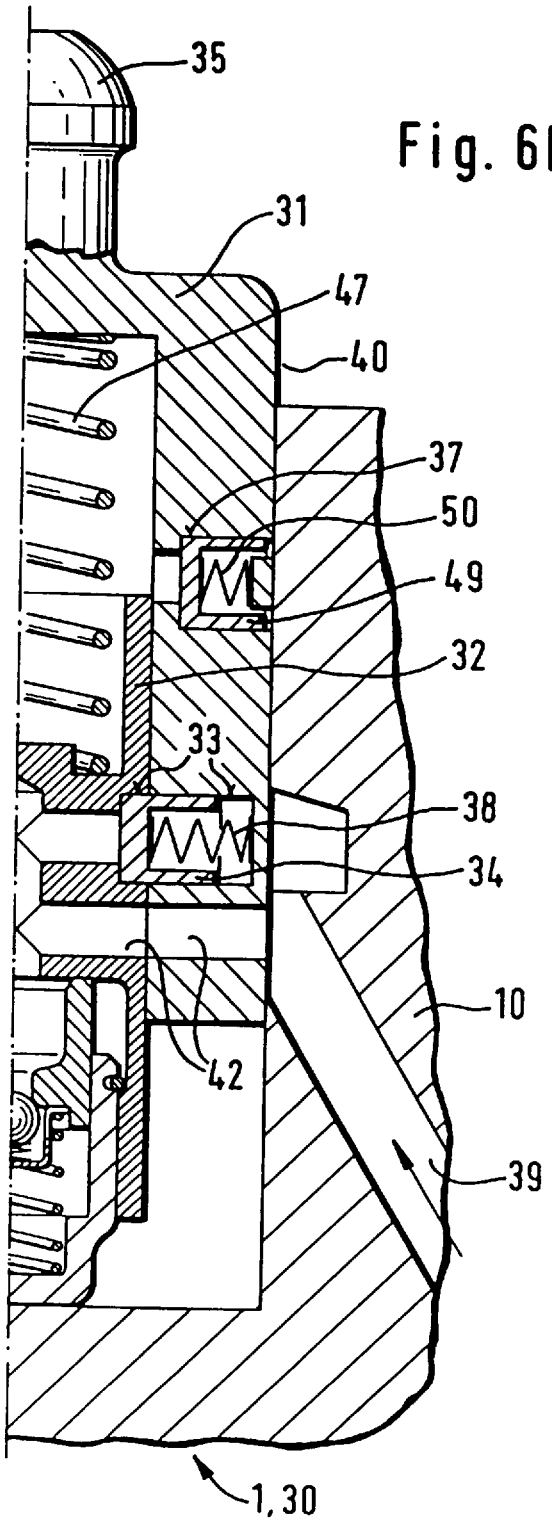
FIG. 6*b* is a sectional view of the support element of FIG. 6*a* in a position in which the finger lever is coupled with the control cam.

In the embodiment of FIGS. 6*a* and 6*b*, at least one further piston 49 is provided in the support element 30 for uncoupling the finger lever 53 from the control cam. This further piston 49 is positioned in the further bore 37 of the housing 31. For uncoupling the finger lever 53 from the cam, the piston 49 engages into the further bore 37 of the cylinder head against the force of at least one compression spring 50 which biases it in a restoring direction. The further bores 37 of the housing 31 and the cylinder head are aligned in the phase of maximum cam lift when the support element 30 is unlocked so that the further piston 49 is displaced against the force of the compression spring 50, by the pressure of hydraulic medium applied through the bore 42, into the further bore 37 of the cylinder head 10 so as to bridge the annular gap 41 formed between the housing 31 and the cylinder head 10.

Hydraulic medium is again fed through the supply duct 39 in the cylinder head 10 to the housing 31. A bore 42 extending through the housing 31 and the inner element 32 registers with the supply duct 39 in the base circle phase of the cam when the support element 30 is unlocked. If now, an uncoupling of the finger lever 53 from the control cam is desired, the pressure of hydraulic medium in the supply duct 39 is raised (see FIG. 6*b*). This displaces the first pistons 34 out of engagement with their first bores 33 in the inner element 32. The housing 31 performs an idle stroke in cam-distal direction. When the bottom dead center position of this idle stroke of the housing 31 has been reached, the further piston 49 which extends in the housing 31 comes to be located radially opposite the further bore 37 of the cylinder head 10. The further piston 49 is now displaced radially outwards against the force of the compression spring 38 by the pressure of hydraulic medium into the further bore 37 so as to bridge the annular gap 41 between the cylinder head 10 and the housing 31. Thus, again, uncoupling in accordance with the invention is achieved. To neutralize this uncoupling, the pressure of the hydraulic medium is reduced so that the further piston 49 is displaced radially inwards by the compression spring 50.

Figure 7:
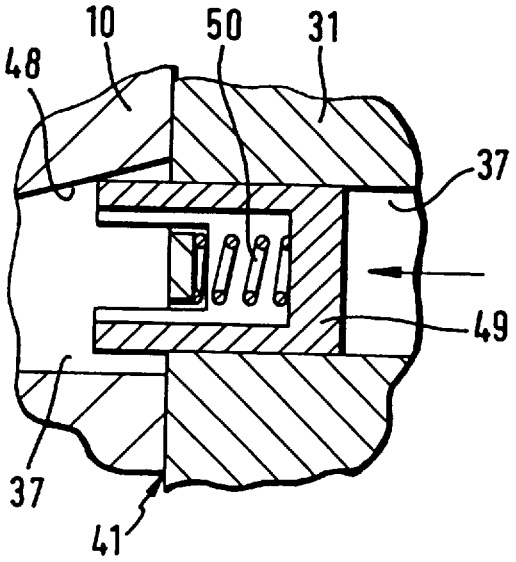
FIG. 7 is a sectional cutaway view of the support element in an area marked c) in FIG. 6*a;*

FIG. 7 shows an enlarged detail c) from FIG. 6*a* illustrating a means for an additional travel of the housing 31 in cam-distal direction analogous to that of FIGS. 2 and 5.

Figure 8A:
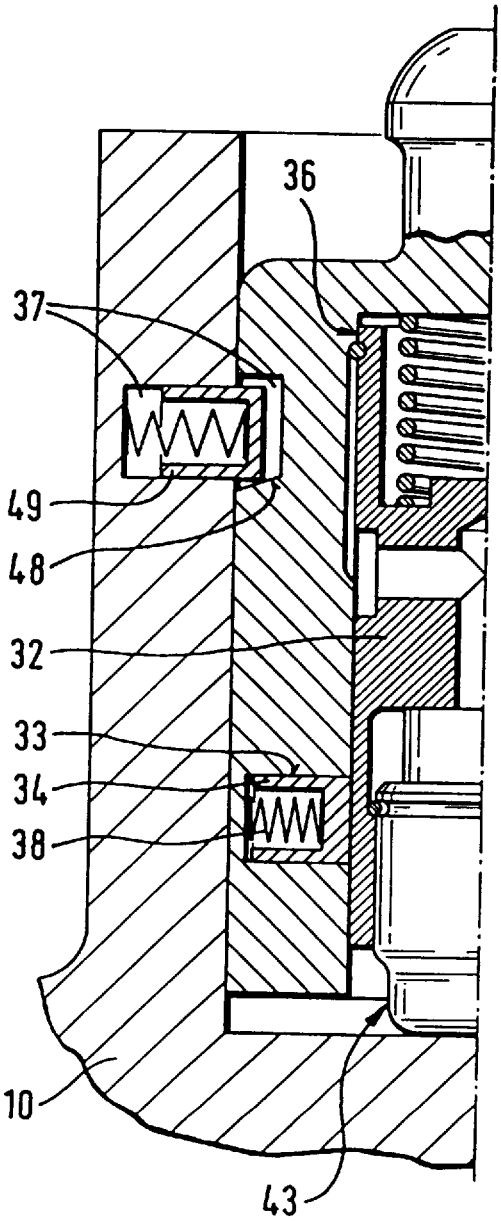
FIG. 8*a* is a sectional view of a second embodiment of a switchable cam follower configured as a support element, illustrating the switching mechanism in a position in which the finger lever is uncoupled from the control cam.
Figure 8B:
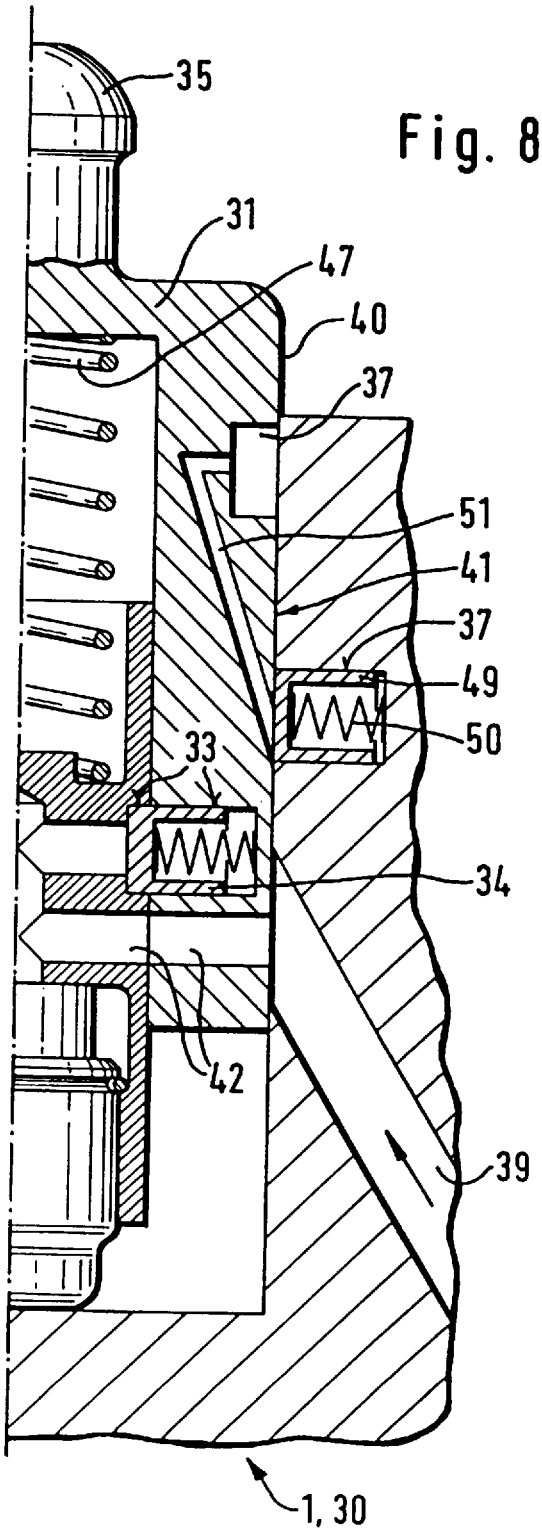
FIG. 8*b* is a sectional view of the support element of FIG. 8*a* in a position in which the finger lever is coupled with the control cam.

FIGS. 8*a* and 8*b* show a support element 30 similar to the support elements disclosed in FIGS. 4 and 6. The further piston 49 is arranged in the further bore 37 of the cylinder head 10. As described in several examples above, to effect uncoupling, this piston 49 is displaced radially inwards by the force of the compression spring 50 into the further bore 37 of the housing 31. A re-positioning of the further piston 49 is achieved in this case by means of a supply duct 51 arranged in the housing 31 at a slight inclination to the central longitudinal plane of the switching mechanism 1. This duct 51 opens into the duct 39 of the cylinder head at least in the phase of maximum cam lift in the uncoupled state of the support element 30. To effect an uncoupling of the housing 31 from the cylinder head 10, the pressure of hydraulic medium in the supply duct 39 is raised and the further piston 49 is displaced against the force of its compression spring 50 radially outwards into the recess 37. The housing 31 performs a stroke in direction of its upper dead center position and is assisted therein by the compression spring 47. In this position, the first bores 33 of the housing 31 and the inner element 32 are aligned so that the first piston 34 is displaced partially out of its first bore 33 in the housing 31 into the first bore 33 in the inner element 32 50 that the piston 34 bridges the annular gap 36 between the housing 31 and the inner element 32. The switching mechanism 1 now works as a conventional support element 30.

Figure 9:
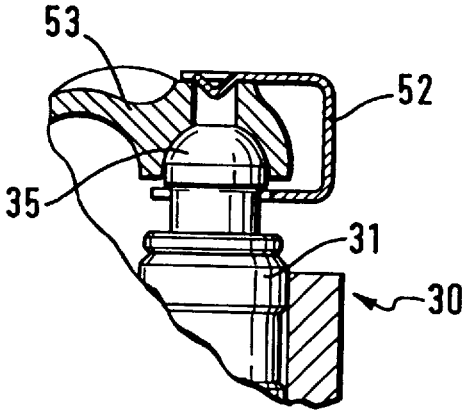
FIG. 9 is a partial view of a switching mechanism according to the present invention, showing in detail a securement thereof to the cam follower.

From FIG. 9 it can be seen that the support element 30 is connected to the associated finger lever 53 by a clasplike connection 52. Due to this connection 52, a driving separation of the finger lever 53 from its associated control cam is accomplished upon uncoupling.

Figure 10:
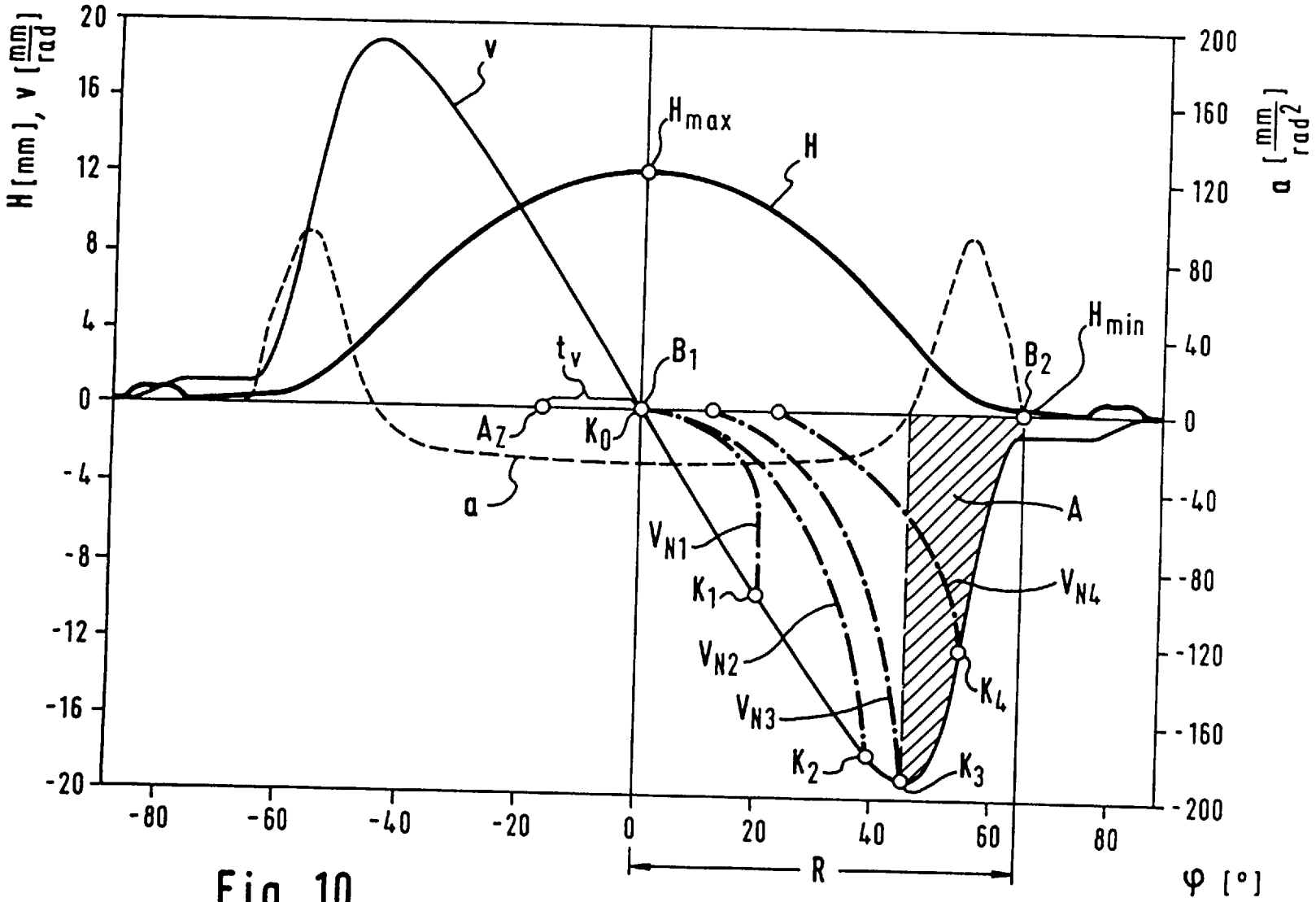
FIG. 10 is a diagram showing graphical curves of preferred phases for a re-coupling of the uncoupled element.

FIG. 10 is a diagram showing preferred phases for re-coupling. $K_0$ to $K_4$ are the possible points of time of impact of the lagging cam follower on the cam. As can be seen from the curves, it is desirable for these two elements to have the same or only slightly differing speeds at the time of impact. With consideration to system-inherent delays, re-coupling can be started earlier depending on the speeds of rotation. If the uncoupled element is moved toward the control cam in the phase A, its compression spring must only be so strong that the same speeds exist at the time of impact.

While the invention has been illustrated and described as embodied in a device and method for operating a valve drive of an internal combustion engine, it is not intended to be limited to the details shown since various modifications and structural changes may be made without departing in any way from the spirit of the present invention.

What is claimed as new and desired to be protected by Letters Patent is set forth in the appended claims:

1. A valve drive device of an internal combustion engine, comprising a switching mechanism incorporated in a support element for support of a cam follower disposed in driving relationship between a camshaft and a gas exchange valve for switching the gas exchange valve to different valve lift curves in response to an operation of a cam arrangement, said support element including:

a hollow cylindrical housing including an axis and received within an enveloping outer casing;

an inner element axially displaceable relative to the housing and so received within the housing as to form at their interface an annular gap;

and said switching mechanism including coupling means movable in a radial direction of said housing in a first radial bore arrangement so as to couple the inner element with the housing during a base circle phase of the cam arrangement by bridging the annular gap to thereby maintain a contact of the cam follower upon the cam arrangement, said coupling means being movable in the radial direction of said housing in a second bore arrangement which is spaced from the first radial bore arrangement in a direction of the axis so as to effect a disengagement of the cam follower from the cam arrangement in a phase of maximum cam lift.

2. The device of claim 1 wherein the coupling means includes a coupling element in the form of a piston displaceably received in the first radial bore arrangement comprised of one bore formed in the housing and another bore formed in the inner element, said bores of the first bore arrangement being aligned in the base circle phase of the cam arrangement for allowing the coupling element to bridge the annular gap, thereby coupling the housing and the inner element to one another, wherein the housing or the inner element has formed therein the second bore arrangement for engagement of the coupling element in the phase of maximum cam lift to thereby bridge the annular gap between the housing and the inner element for uncoupling of the cam follower from the cam arrangement.

3. The device of claim 2 wherein the cam follower is a finger lever.

4. The device of claim 2 wherein the coupling means includes a compression spring for loading the coupling element to move radially outwards for seeking a position in which the cam follower is disengaged from the cam arrangement, and further comprising hydraulic force-transmitting means acting in opposition to the spring for displacing the coupling element in a radially inward direction by a hydraulic medium to re-establish a contact between the cam follower and the cam arrangement during a closing phase of the gas exchange valve between a maximum valve lift and a minimum valve lift.

5. The device of claim 4 wherein the hydraulic force-transmitting means includes a supply duct formed in the outer casing and communicating with a longitudinally extending annular gap which, at least partially, surrounds an outer peripheral surface of the housing for permitting hydraulic medium to urge the coupling element in a radially inward direction.

6. The device of claim 2 wherein the second bore arrangement exhibits a bevel for engagement by the piston to effect an additional travel of the housing in a cam-distal direction when the cam follower is uncoupled from the cam arrangement.

7. The device of claim 2 wherein the cam follower is a finger lever, and further comprising a clasp-like connection for linking the housing in driving relationship to the finger lever.

8. The device of claim 1 wherein the support element includes a hydraulic clearance compensation unit.

9. The device of claim 1 wherein at least one component selected from the group consisting of the housing and the inner element is made of a light weight or polymeric material.

10. The device of claim 1 wherein the coupling means includes a first coupling element in the form of a piston displaceably received in the first radial bore arrangement comprised of one bore formed in the housing and another bore formed in the inner element, said bores of the first bore arrangement being aligned in a base circle phase of a cam arrangement of the camshaft for allowing the first coupling element to bridge the annular gap for coupling the housing and the inner element to one another, and a second coupling element so displaceably received in the second bore arrangement formed in the outer casing or the housing as to bridge an annular gap between the housing and the outer casing in a phase of maximum cam lift for uncoupling the cam follower from the cam arrangement.

11. The device of claim 10 wherein the outer casing is formed with a supply duct to convey a hydraulic medium to radial channels formed in the housing and the inner element and aligned at least in the base circle phase of the cam arrangement for forcing the first and second coupling elements in a radially outward direction.

12. The device of claim 10 wherein the outer casing is formed with a first supply duct to convey a hydraulic medium to radial channels formed in the housing and the inner element and aligned at least in the base circle phase of the cam arrangement for forcing the first coupling element in a radially outward direction, said housing having formed therein a second supply duct communicating with the second bore for conveying hydraulic medium to act upon the second coupling element, said second supply duct extending at a slight inclination with respect to a central longitudinal plane of the support element and being connected, at least in the phase of maximum cam lift, with the first supply duct.

13. The device of claim 10 wherein the second bore arrangement exhibits a bevel for engagement by the second coupling element to effect an additional travel of the housing in a cam-distal direction upon disconnection of the cam follower from the cam arrangement.

14. The device of claim 10 wherein the cam follower is a finger lever, and further comprising a clasp-like connection for linking the housing in driving relationship to the finger lever.

15. The device of claim 10 wherein the support element includes a hydraulic clearance compensation unit.

16. The device of claim 10 wherein at least one component selected from the group consisting of housing and inner element is made of a light-weight or polymeric material.

* * * * *